US006385934B1

(12) United States Patent
Zickell et al.

(10) Patent No.: US 6,385,934 B1
(45) Date of Patent: May 14, 2002

(54) WEATHERPROOFING MEMBRANE HAVING HIGH TRACTION SURFACE

(75) Inventors: Thomas J. Zickell, Stratham, NH (US); Charles Diman, Billerica, MA (US); James A. Karlis, Pelham, NH (US)

(73) Assignee: Northern Elastomeric, Inc., Brentwood, NH (US)

( * ) Notice: Subject to any disclaimer, the term of this patent is extended or adjusted under 35 U.S.C. 154(b) by 0 days.

(21) Appl. No.: 09/359,151

(22) Filed: Jul. 22, 1999

(51) Int. Cl.[7] ..... E04B 5/00

(52) U.S. Cl. ..... 52/408; 52/169.14; 52/409; 52/748; 428/40.1

(58) Field of Search ..... 52/41, 169.14, 52/173, 408, 409, 748, 420; 428/40.1, 40.8

(56) References Cited

U.S. PATENT DOCUMENTS

| | | | | |
|---|---|---|---|---|
| 2,705,209 A | | 3/1955 | Rowe | 154/51 |
| 3,849,229 A | * | 11/1974 | Spillane et al. | 156/304 |
| 3,965,633 A | * | 6/1976 | Carroll | 52/309 |
| 4,000,140 A | | 12/1976 | Tierney | 260/28.5 |
| 4,032,491 A | | 6/1977 | Schoenke | 260/28.5 |
| 4,045,265 A | * | 8/1977 | Tajima et al. | 156/71 |
| 4,235,953 A | | 11/1980 | Kumins et al. | 428/332 |
| 4,302,370 A | * | 11/1981 | Buse | 260/28.5 AS |
| 4,345,004 A | * | 8/1982 | Miyata et al. | 428/416 |
| 4,396,665 A | | 8/1983 | Rowe | 428/148 |
| 4,521,478 A | | 6/1985 | Hageman | 428/287 |
| 4,585,682 A | | 4/1986 | Colarusso et al. | 428/57 |
| 4,757,652 A | | 7/1988 | Kalkanoglu | 52/173 |
| 4,775,567 A | | 10/1988 | Harkness | 428/40 |
| 4,835,199 A | * | 5/1989 | Futamura et al. | 524/66 |
| 4,868,233 A | * | 9/1989 | Moran | 524/71 |
| 4,870,796 A | * | 10/1989 | Hart et al. | 52/409 |
| 4,965,977 A | * | 10/1990 | White | 52/410 |
| 5,028,487 A | * | 7/1991 | Kindt et al. | 428/489 |
| 5,096,759 A | | 3/1992 | Simpson et al. | 428/40 |
| 5,516,817 A | * | 5/1996 | Slusher et al. | 523/179 |
| 6,100,317 A | * | 8/2000 | Liang et al. | 524/69 |

OTHER PUBLICATIONS

Eastman Chemical Company, Adhesives and Sealants Product Guide, May 11, 1999.
Equistar Chemical Company, Products We Offer, ©1997.
Equistar Chemical Company, New High–Performance LLDPE From Equistar for Film Requiring Superior Strength and Toughness, Houston, Texas, Feb. 22, 1999.
GRM—Grace Roofing Membrane, Product Description for GRM Roofing Membranes, Jan. 1, 1984.

* cited by examiner

*Primary Examiner*—Bruce A. Lev
(74) *Attorney, Agent, or Firm*—Bourque & Associates, PA

(57) ABSTRACT

A weatherproofing membrane having a high traction surface is used on a roof or other such location to prevent individuals from slipping. The weatherproofing membrane includes a facer sheet formed of a weatherproofing material and one or more polymer regions disposed on an upper side of the facer sheet. The weatherproofing membrane also includes a layer of modified asphalt disposed on the lower side of the facer sheet and a release backing disposed over the modified asphalt. The polymer is softer than the weatherproofing material and thus provides a higher traction surface than the weatherproofing material of the facer sheet. The polymer includes a low molecular weight polyethylene and an amorphous polyolefin (APO) in respective proportions ranging from about 50/50 to 90/10. The low molecular weight polyethylene and the APO are mixed hot and applied to the facer sheet, for example, using conventional coating techniques.

26 Claims, 2 Drawing Sheets

WEATHERPROOFING MEMBRANE HAVING HIGH TRACTION SURFACE

FIELD OF THE INVENTION

The present invention relates to weatherproofing membranes and in particular, to a weatherproofing membrane having a high traction surface.

BACKGROUND OF THE INVENTION

Weatherproofing membranes are commonly used in roofing and other similar applications. The membrane is usually applied to the roof or other such structure to provide weatherproofing. Such membranes typically include a substrate or facer sheet made of a polymer, such as polyethylene, that has an inherently slippery surface. The slippery upper surface of these materials creates a hazard both for the workers applying the membranes and also to any other individual climbing or walking on the slippery polymer surface of the weatherproofing membrane.

Accordingly, a need exists for a weatherproofing membrane having a high traction surface.

SUMMARY OF THE INVENTION

The present invention features a weatherproofing membrane comprising at least one facer sheet having an upper side and a lower side and being formed of a weatherproofing material. At least one layer of polymer is disposed on at least one region of the upper side of the facer sheet to provide a higher traction than the weatherproofing material. In one embodiment, the region with the polymer includes a plurality of stripes of the polymer disposed on the upper side of the facer sheet. At least one layer of modified asphalt is disposed on at least a portion of the lower side of the facer sheet. The weatherproofing membrane can also include a release backing releasably disposed over the layer of modified asphalt.

The polymer preferably includes a mixture of at least a low molecular weight polyethylene and an amorphous polyolefin. The proportion of low molecular weight polyethylene to amorphous polyolefin ranges from about 50/50 to 90/10. In one preferred embodiment, the mixture includes about 75% of the low molecular weight polyethylene and about 25% of the amorphous polyolefin. One example of the amorphous polyolefin is a polypropylene/propylene-ethylene copolymer resin mixture.

The weatherproofing membrane is preferably a plastic film, such as a high density cross-laminated polyethylene film or a straight high density polyethylene film.

The modified asphalt is preferably a polymer modified asphalt composition. The softening point of the polymer used for the high traction surface is preferably greater than a softening point of the modified asphalt.

The present invention also features a method of making a membrane having a high traction polymer surface. The method comprises the steps of: hot mixing a quantity of amorphous polyolefin with a quantity of low molecular weight polyethylene to form a polymer blend; and applying the polymer blend to at least a portion of the membrane. The hot mixing can be performed in a hot mix tank or an extruder and is preferably performed in a temperature range of about 300° F. to 400° F.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
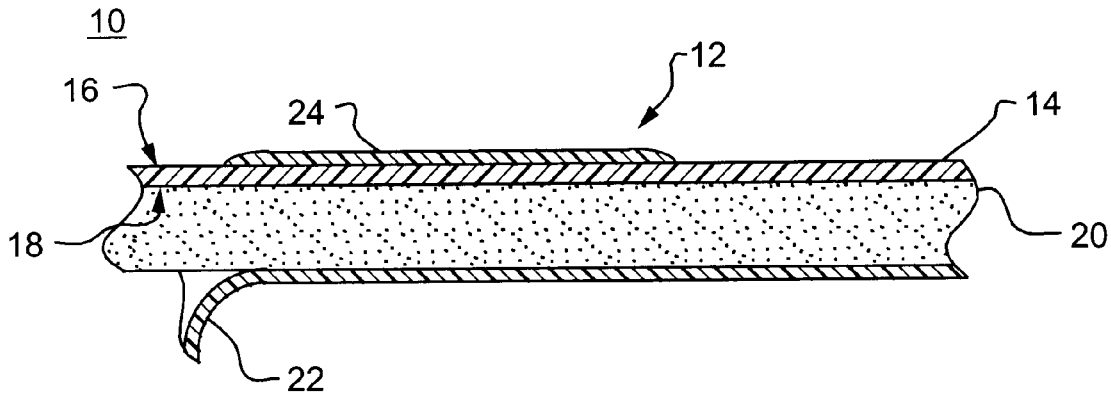
FIG. 1 is a cross-sectional view of the weatherproofing membrane having a high traction surface, according to the present invention.

A weatherproofing membrane 10, FIG. 1, according to the present invention, has a high traction surface 12 to prevent individuals from slipping when walking on the weatherproofing membrane 10. The weatherproofing membrane 10 having the high traction surface 12 can be used on roofs and other such surfaces to provide weatherproofing. The high traction surface 12, as described in greater detail below, can also be used on other types of membranes or surfaces and in other applications.

According to the exemplary embodiment, the weatherproofing membrane 10 includes at least one facer sheet 14 having an upper side 16 and a lower side 18. The facer sheet 14 is formed of a weatherproofing material, such as a polyethylene or other type of plastic film, having a generally low traction surface. At least one layer of modified asphalt 20 is disposed on at least a portion of the lower side 18 of the facer sheet 14. A release backing 22 is releasably disposed over the layer of modified asphalt 20.

Figure 2:
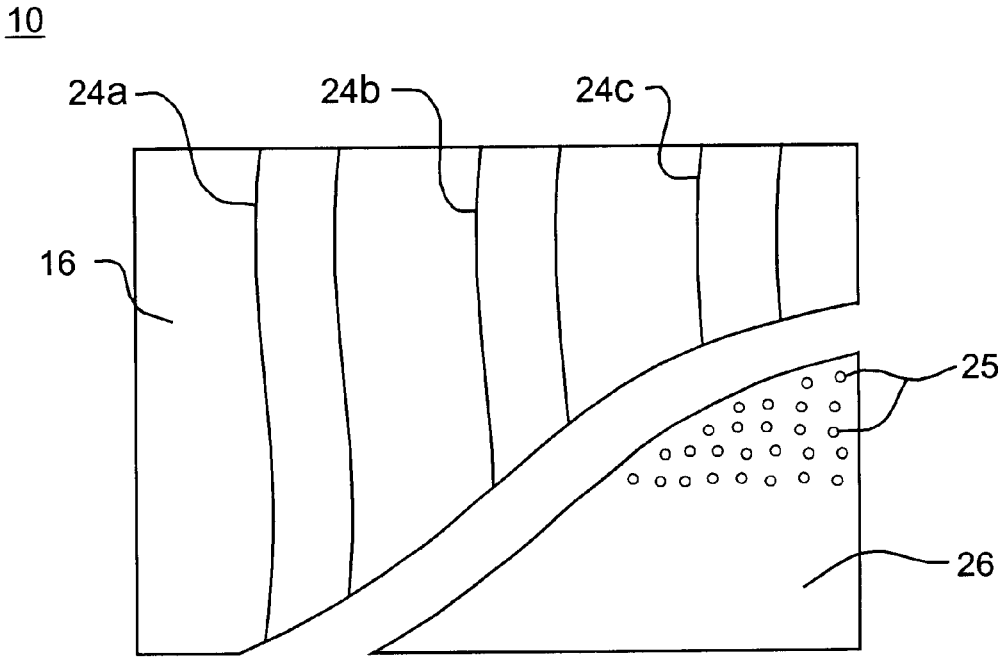
FIG. 2 is a top plan view of the weatherproofing membrane having stripes of polymer, polymer dots and/or a polymer film according to various embodiments of the invention.

The high traction surface 12 includes at least one layer of a polymer 24 that provides a higher traction than the weatherproofing material of the facer sheet 14. Because the polymer 24 is softer than the weatherproofing material of the facer sheet 14, e.g. polyethylene, the polymer 24 can provide up to about twice as much traction than the facer sheet 14. The polymer 24 is preferably disposed on at least one region of the upper side 16 of the facer sheet 14. In one example, polymer stripes 24*a*–24*c*, FIG. 2, are applied on the upper surface 16 of the facer sheet 14 to create the high traction surface 12. The polymer 24 can also be applied in other configurations or patterns creating separate and distinct regions on the upper side 16 of the facer sheet 14.

The polymer 24 is preferably a blend of at least one polymer component having high adhesion properties and at least one polymer component having high strength properties. According to the exemplary embodiment, the polymer having the high adhesion properties is a low molecular weight polyethylene, and the polymer having the high strength properties is an amorphous polyolefin (APO), such as a polypropylene/propylene-ethylene copolymer mixture. The low molecular weight polyethylene and the APO are preferably blended such that the resulting polymer 24 has the desired combined strength and adhesion properties. If too much APO is blended, the polymer 24 will not have sufficient adhesion and will not provide the desired traction. If too much low molecular weight polyethylene is blended, the resulting polymer 24 will not have sufficient strength and may break away under foot pressure. The polymer 24, when applied to the membrane 10, should also preferably have a softening point that is above that of the modified asphalt composition 20. In one example, the ring and ball softening point of the polymer 24 should be in the range of about 200°–300° F.

To accomplish the desired strength and adhesion properties, the proportion of low molecular weight polyethylene to APO is in the range of 50/50 to 90/10. In one example, a mixture including about 75% low molecular weight polyethylene and about 25% APO was found to achieve the desired properties.

The typical properties of the low molecular weight polyethylene that can be used in the polymer 24 of the present invention are as follows:

| | |
|---|---|
| Molecular Wt | |
| $M_n$ | 5,600 |
| $M_w$ | 26,000 |
| R & B Softening Point ° C.(° F.) | 106 (223) |
| Viscosity | |
| 150° C. | 8,500 |

One type of low molecular weight polyethylene that can be used is available under the name EPOLENE from Eastman Chemical Company. Another example of the low molecular weight polyethylene is available under the name PETROTHENE available from Equistar Chemicals in Houston, Tex. Other types of low molecular weight polyethylene products having the desired adhesion properties can also be used.

The typical properties of the polypropylene/propylene-ethylene copolymer mixture that can be used in the polymer 24 of the present invention are as follows:

| | |
|---|---|
| Viscosity 190° C., mPa · s | 1,000 to 5,800 |
| R & B Softening Pt. ° C. (° F.) | 145 to 153 (293 to 307) |
| Glass Trans. Temp. ° C. (° F.) | −21 to −10 (−6 to 14) |
| Penetration Hardness, dmm | 25 to 40 |
| Tensile Strength, MPa (psi) | .34 to 1.24 (50 to 180) |
| Elongation, % | 35 to 100 |

One type of APO that can be used is the polypropylene/propylene-ethylene copolymer mixture available under the name EASTOFLEX from Eastman Chemical Company. Other types of amorphous polyolefins having the desired strength characteristics can also be used.

According to one example, the plastic film used in the facer sheet 14 is a high density cross-laminated polyethylene film. One example of this type of membrane 10 is available under the name AC POLY® ICE & STORMSEAL available from Northern Elastomeric, Inc. of Brentwood, N.H. According to another example, the plastic film used in the facer sheet 14 is a straight high density polyethylene film. One example of this type of membrane 10 is sold under the name AC SMOOTHSEAL, also available from Northern Elastomeric, Inc. In these examples, the modified asphalt is a polymer modified asphalt, such as the polyethylene modified asphalt disclosed in application Ser. No. 09/329,466 entitled POLYMER MODIFIED ASPHALT COMPOUNDS AND METHOD FOR PREPARING SAME, assigned to the assignee of the present invention and incorporated herein by reference. The high traction surface 12 can be applied to other types of membranes having other types of plastic films or facer sheets that are made of a low traction material and with other types of modified asphalt compositions.

Figure 3:
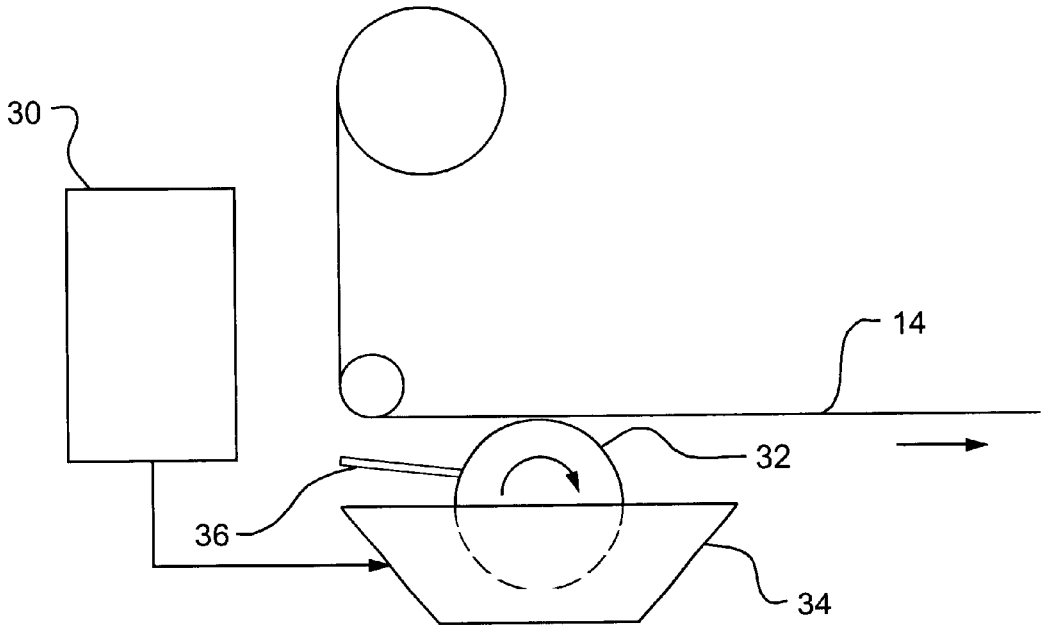
FIGS. 3 and 4 are schematic diagrams of a system and method for applying the polymer stripes, according to one embodiment of the present invention.

According to one system and method of making the weatherproofing membrane 10, FIG. 3, according to the present invention, the low molecular weight polyethylene and the APO are blended and mixed hot, for example, in a temperature range of about 250°–350° F. The hot mixing can be performed in a hot mix tank, an extruder, or any other device 30 capable of hot mixing. In one method, the low molecular weight polyethylene is first mixed and heated in an extruder and then is combined and hot mixed with the APO in a hot mix tank. Mixing occurs until the two polymers are adequately blended, as can be determined by one of ordinary skill in the art.

Figure 4:
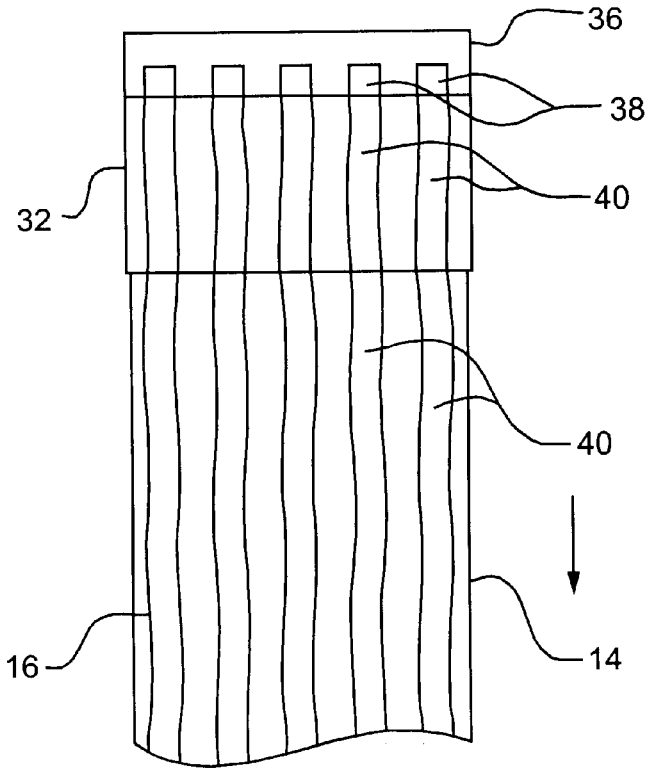

The hot polymer blend is then applied to the upper surface 16 of the facer sheet 14, preferably after the modified asphalt has been applied to the lower surface 18 of the facer sheet 14. According to one example of applying the polymer, the hot polymer blend is transferred to a roll coater 32 that turns inside a melted bath 34 of the hot polymer blend and picks up a coating of the hot polymer blend around an outer surface thereof. A blade 36, FIG. 4, having notches 38 cut out from one edge of the blade 36 is dragged across the outer surface of the roll 32 to form lines of the hot polymer blend around the outer surface of the roll 32. These lines 40 of hot polymer are then transferred to the upper surface 16 of the facer sheet 14 to form the polymer stripes 24*a*–24*c* (see FIG. 2).

According to another alternative, the hot polymer blend can be extruded onto the upper surface 16 of the facer sheet 14 to form the polymer stripes 24*a*–24*c*. Various other methods can also be used to apply the polymer 24 to the facer sheet 14 in any desired pattern including but not limited to polymer "dots" 25 or a polymer film 26.

The present invention is further illustrated by the following example which is intended as an illustration only and not a limitation on the present invention.

EXAMPLE

In one example, about 25% of the EASTOFLEX APO was mixed with about 75% of the EPOLENE low molecular weight polyethylene at a temperature of about 250° F. for about 15 minutes. About 1 lb./CSF of the mixture was then applied at the same temperature using a roll coater to form the high traction surface. When the high traction surface was tested using a weighted shoe sole on an inclined board, the traction appeared to improve by about 50%.

Accordingly, the polymer on the weatherproofing membrane of the present invention provides a high traction surface on the typically low traction facer sheet surface of the weatherproofing membrane. The weatherproofing membrane having the high traction surface is thus capable of preventing individuals from slipping, for example, on roofs or other surfaces susceptible to slipping.

Modifications and substitutions by one of ordinary skill in the art are considered to be within the scope of the present invention which is not to be limited except by the claims which follow.

What is claimed is:

1. A weatherproofing membrane comprising:

at least one facer sheet having an upper side and a lower side, said at least one facer sheet being formed of a weatherproofing material;

a high traction polymer blend disposed on a plurality of separate and distinct regions of said upper side of said at least one facer sheet, wherein said polymer blend is non-bituminous and includes at least first and second polymer components, said first polymer component having relatively high adhesion properties and said second polymer component having relatively high strength properties, wherein said plurality of separate and distinct regions including said high traction polymer blend provides a higher traction than said weatherproofing material of said facer sheet; and at least one layer of modified asphalt disposed on at least a portion of said lower side of said facer sheet.

2. The weatherproofing membrane of claim 1 further including a release backing releasably disposed over said at least one layer of modified asphalt.

3. The weatherproofing membrane of claim 1 wherein said weatherproofing material includes a plastic film.

4. The weatherproofing membrane of claim 3 wherein said plastic film is a high density cross-laminated polyethylene film.

5. The weatherproofing membrane of claim 3 wherein said plastic film facer is a straight high density polyethylene film.

6. The weatherproofing membrane of claim 1 wherein said modified asphalt is a polymer modified asphalt composition.

7. The weatherproofing membrane of claim 1 wherein a softening point of said polymer is greater than a softening point of said modified asphalt.

8. The weatherproofing membrane of claim 1 wherein said plurality of separate and distinct regions of said high traction polymer blend are stripes.

9. The weatherproofing membrane of claim 1 wherein said polymer blend comprises a mixture of low molecular weight polyethylene and amorphous polyolefin.

10. The weatherproofing membrane of claim 9 wherein said amorphous polyolefin is a polypropylene/propylene-ethylene copolymer resin mixture.

11. The weatherproofing membrane of claim 9 wherein said high traction polymer blend includes said low molecular weight polyethylene and said amorphous polyolefin in respective proportions ranging from about 50/50 to 90/10.

12. The weatherproofing membrane of claim 11 wherein said amorphous polyolefin is a polypropylene/propylene-ethylene copolymer resin mixture.

13. The weatherproofing membrane of claim 9 wherein said high traction polymer blend includes about 75% of said low molecular weight polyethylene and about 25% of said amorphous polyolefin.

14. A method of making a membrane having a high traction polymer surface, said method comprising the steps of:

providing a membrane including at least one facer sheet;

hot mixing a quantity of amorphous polyolefin with a quantity of low molecular weight polyethylene to form a non-bituminous polymer blend; and applying said polymer blend to a plurality of separate and distinct regions of an upper side of said facer sheet of said membrane.

15. The method of claim 14 wherein said mixture includes said low molecular weight polyethylene and said amorphous polyolefin in respective proportions ranging from about 50/50 to 90/10.

16. A membrane made according to the method claim 15, wherein said polymer blend is applied in at least two separate and distinct regions to an upper side of said membrane.

17. The method of claim 14 wherein said mixture includes about 75% of said low molecular weight polyethylene and about 25% of said amorphous polyolefin.

18. A membrane made according to the method of claim 17, wherein said polymer blend is applied in at least two separate and distinct regions to an upper side of said membrane.

19. The method of claim 14 wherein said amorphous polyolefin is a polypropylene/propylene-ethylene copolymer resin mixture.

20. The method of claim 14 wherein the step of hot mixing is performed in a hot mix tank.

21. The method of claim 14 wherein the step of hot mixing includes initially mixing said low molecular weight polyethylene in an extruder and then mixing said low molecular weight polyethylene with said amorphous polyolefin in a mixing tank.

22. The method of claim 14 wherein the step of hot mixing is performed in a temperature in the range between 250° F. to 350° F.

23. A membrane made according to the method of claim 14.

24. The method of claim 14 further including the step of applying a release backing releasably disposed over said layer of modified asphalt.

25. A weatherproofing membrane comprising:

at least one facer sheet having an upper side and a lower side, said at least one facer sheet being formed of a weatherproofing material;

at least one layer of a high traction polymer blend disposed on a plurality of separate and distinct regions of said upper side of said at least one facer sheet, said polymer blend comprising a mixture of low molecular weight polyethylene and amorphous polyolefin, wherein said plurality of separate and distinct regions including said high traction polymer blend provides a higher traction than said weatherproofing material of said facer sheet; and at least one layer of modified asphalt disposed on at least a portion of said lower side of said facer sheet.

26. The method of claim 14 wherein said membrane includes at least one layer of modified asphalt on a lower side of said facer sheet.

* * * * *